US007304615B2

(12) United States Patent
Nakamura

(10) Patent No.: US 7,304,615 B2
(45) Date of Patent: Dec. 4, 2007

(54) WIDEBAND RECEIVING ANTENNA DEVICE

(75) Inventor: Yusuke Nakamura, Fukushima-ken (JP)

(73) Assignee: ALPS Electric Co., Ltd., Ota-Ku, Tokyo (JP)

( * ) Notice: Subject to any disclaimer, the term of this patent is extended or adjusted under 35 U.S.C. 154(b) by 0 days.

(21) Appl. No.: 11/523,264

(22) Filed: Sep. 18, 2006

(65) Prior Publication Data

US 2007/0115197 A1 May 24, 2007

(30) Foreign Application Priority Data

Nov. 22, 2005 (JP) ..... 2005-337483

(51) Int. Cl.
*H01Q 7/08* (2006.01)

(52) U.S. Cl. ..... 343/788; 343/895

(58) Field of Classification Search ..... 343/787, 343/788, 895, 742, 743, 867
See application file for complete search history.

(56) References Cited

U.S. PATENT DOCUMENTS 3,946,397 A 3/1976 Irwin
4,805,232 A * 2/1989 Ma ..... 455/291
6,529,169 B2 * 3/2003 Justice ..... 343/788
7,123,206 B2 * 10/2006 Hess et al. ..... 343/788

FOREIGN PATENT DOCUMENTS

JP 51-83755 7/1976
JP 2005-210564 8/2005

* cited by examiner

*Primary Examiner*—Hoang V. Nguyen
(74) *Attorney, Agent, or Firm*—Beyer Weaver LLP

(57) ABSTRACT

An antenna device includes a substrate formed of a dielectric body or a magnetic body, first to third radiation conductors wound in spirals around outer circumferential surfaces of the substrate, a plurality of capacitance elements spread over the first radiation conductor and the second radiation conductor, and a high-frequency switch interposed between feed ends. The feed ends are selectively connected to a high-frequency circuit via the high-frequency switch connected to a tuner. Since the total length of the second and third radiation conductors connected in series with each other is longer than that of the first radiation conductor, the first radiation conductor is capable of resonating in a high band and the second and third radiation conductors are capable of resonating in a low band. By changing the capacitances of the variable capacitance elements from the tuner side, a resonant frequency can be changed within a selected frequency band.

4 Claims, 3 Drawing Sheets

WIDEBAND RECEIVING ANTENNA DEVICE

BACKGROUND OF THE INVENTION

1. Field of the Invention

The present invention relates to an antenna device in which a strip-shaped conductor is wound in a spiral around a substrate formed of a dielectric body or a magnetic body so as to be tuned to a desired frequency, and more particularly, to a wideband antenna device suitable for receiving an ultrahigh frequency (UHF) band for television broadcasting and the like.

2. Description of the Related Art

FIG. 4 is a perspective view of a known antenna device 20 in which capacitors are spread over a conductor wound around a magnetic body. FIG. 5 is an equivalent circuit diagram of the antenna device 20 (for example, see JP A 51-83755(Pages 2-3, FIG. 3)). In the known antenna device 20 shown in FIG. 4, a spiral conductor 22 is wound around outer circumferential surfaces of a ferrite core 21. Ends of the spiral conductor 22 serve as connection terminals 23 and 24. The spiral conductor 22 is formed by a plurality of split conductor portions 22*a* connected in series with each other. The adjacent split conductor portions 22*a* are connected to each other with capacitors 25 therebetween. That is, as shown in the equivalent circuit diagram of FIG. 5, the antenna device 20 forms a closed loop circuit in which the capacitors 25 are spread over a line of the spiral conductor 22, and the antenna device 20 is capable of being tuned to a predetermined frequency by supplying a radio-frequency signal to the connection terminals 23 and 24.

However, in the known antenna device 20, excellent receiver sensitivity is achieved only in a limited frequency band. Thus, for example, a UHF band for television broadcasting cannot be received over a range from a lower frequency side (470 MHz to 620 MHz) to a higher frequency side (620 MHz to 770 MHz).

SUMMARY OF THE INVENTION

Accordingly, it is an object of the present invention to provide an antenna device that is capable of achieving excellent receiver sensitivity over a wide frequency range.

In order to achieve the above object, an antenna device according to an aspect of the present invention includes a substrate formed of a dielectric body or a magnetic body; a first radiation conductor that is wound in a spiral around a portion of the substrate, one end of the first radiation conductor serving as a feed end for a radio-frequency signal; a second radiation conductor that is wound around another portion of the substrate in a spiral whose length is equal to the spiral of the first radiation conductor, one end of the second radiation conductor serving as a feed end for the radio-frequency signal; a third radiation conductor that is wound in a spiral around another portion of the substrate and that is connected in series with the second radiation conductor; a plurality of variable capacitance elements spread over the first and second radiation conductors by being connected in series with split conductor portions acquired by splitting each of the first and second radiation conductors into a plurality of sections; and a high-frequency switch that is interposed between the feed ends of the first and second radiation conductors and that is connected to an external high-frequency circuit. The first radiation conductor and the second and third radiation conductors are selectively connected to the high-frequency circuit by supplying a switch control signal to the high-frequency switch so that the first radiation conductor and the second and third radiation conductors resonate in frequency bands different from each other, and a resonant frequency changes within a selected frequency band by supplying a bias control signal to each of the variable capacitance elements to change a capacitance.

In the antenna structure configured as described above, due to the high-frequency switch interposed between the feed end of the first radiation conductor and the feed end of the second radiation conductor, the radiation conductors can be selectively connected to the external high-frequency circuit. In addition, since the total length of the combined radiation conductor acquired by connecting the second radiation conductor and the third radiation conductor in series with each other is longer than the length of the first radiation conductor, a high-band mode in which the first radiation conductor resonates in a first frequency band or a low-band mode in which the second and third radiation conductors resonate in a second frequency band, which is lower than the first frequency band, can be selected in a desired manner. In addition, when a frequency band is selected, the resonant frequency of the first radiation conductor or the resonant frequency of the second and third radiation conductor can be changed in a desired manner within a range in which the capacitances of the variable capacitance elements change. Thus, the antenna device is capable of achieving excellent receiver sensitivity over a wide frequency range.

In the above-mentioned configuration, the high-frequency switch may be mounted on a motherboard. However, it is preferable that the high-frequency switch be mounted on the substrate since the space factor of the motherboard on which the antenna device is mounted can be improved.

In addition, in the above-mentioned configuration, it is preferable that each of the variable capacitance elements be a varactor diode and that a direct-current tuning voltage be applied as a bias control signal to the varactor diode since the configuration can be simplified.

In addition, in the above-mentioned configuration, it is preferable that the frequency band in which the first radiation conductor resonates be a higher frequency side of a UHF band for television broadcasting and that the frequency band in which the second and third radiation conductors resonate be a lower frequency side of the UHF band for television broadcasting since the antenna device can be used as a television broadcasting receiving antenna incorporated into a portable apparatus or the like.

As described above, the antenna device is capable of achieving excellent receiver sensitivity over a wide frequency range. Thus, the antenna device is highly useful and suitable, for example, for a television broadcasting receiving antenna incorporated into a portable apparatus or the like.

DESCRIPTION OF THE PREFERRED EMBODIMENTS

Figure 1:
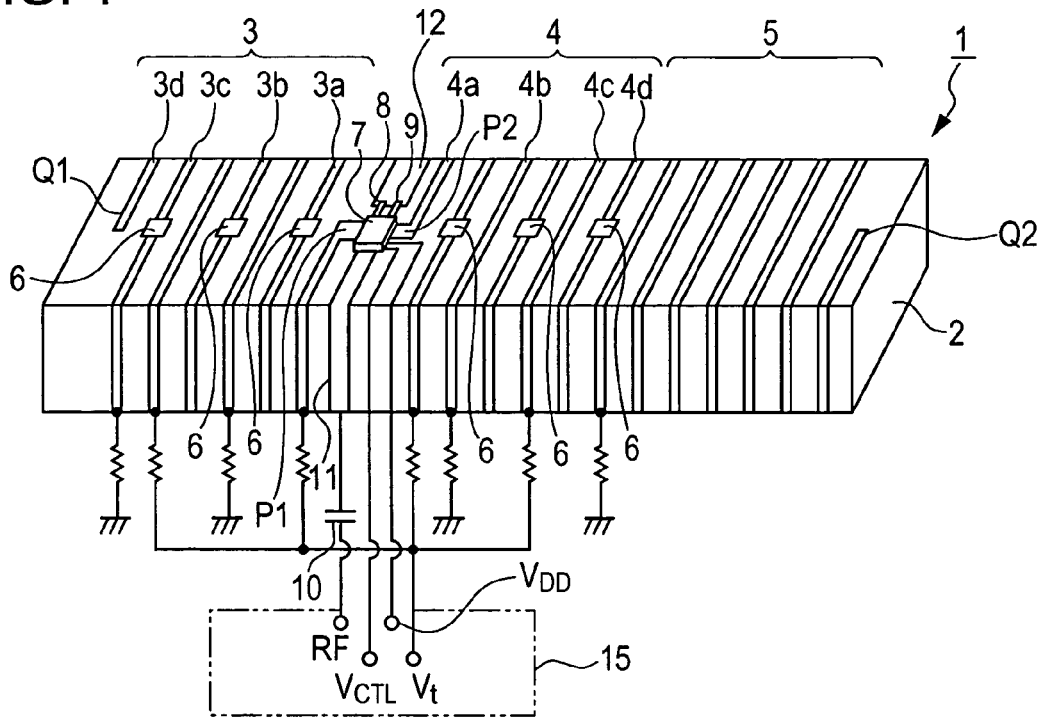
FIG. 1 is a perspective view of an antenna according to an embodiment of the present invention.
Figure 2:
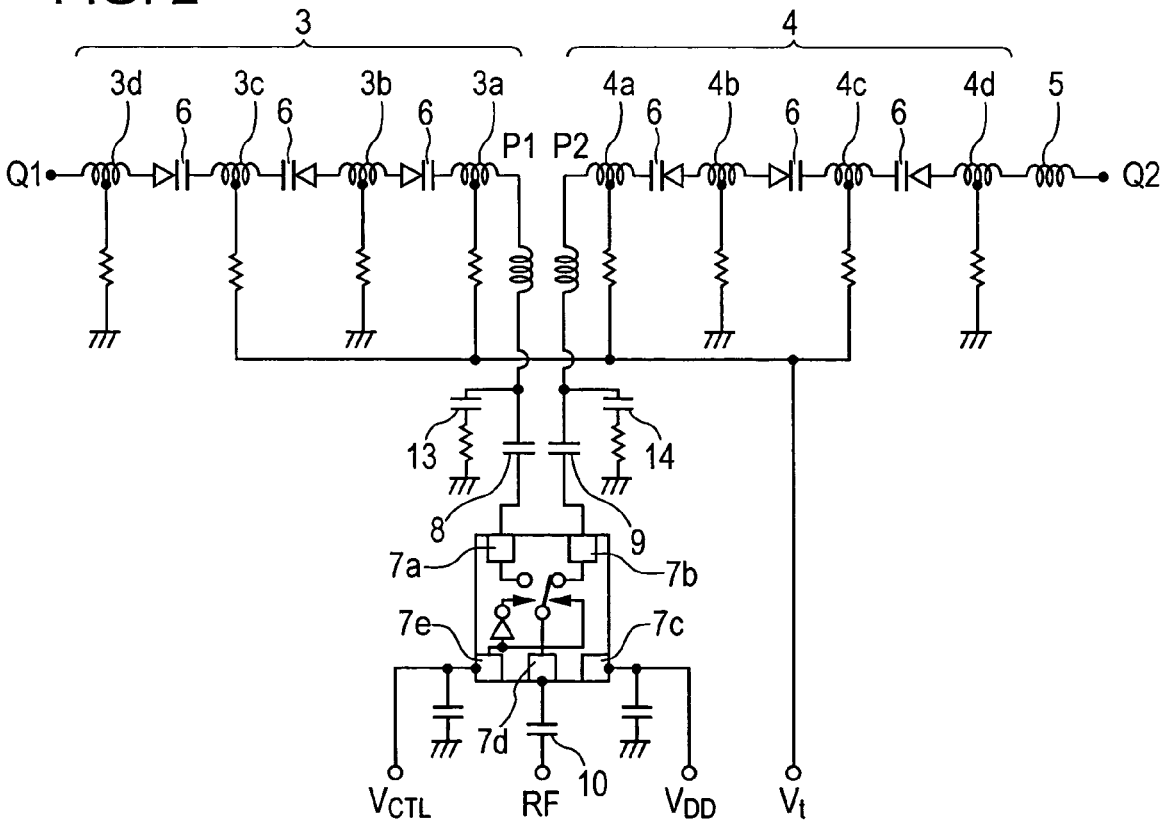
FIG. 2 is an equivalent circuit diagram of the antenna device.
Figure 3:
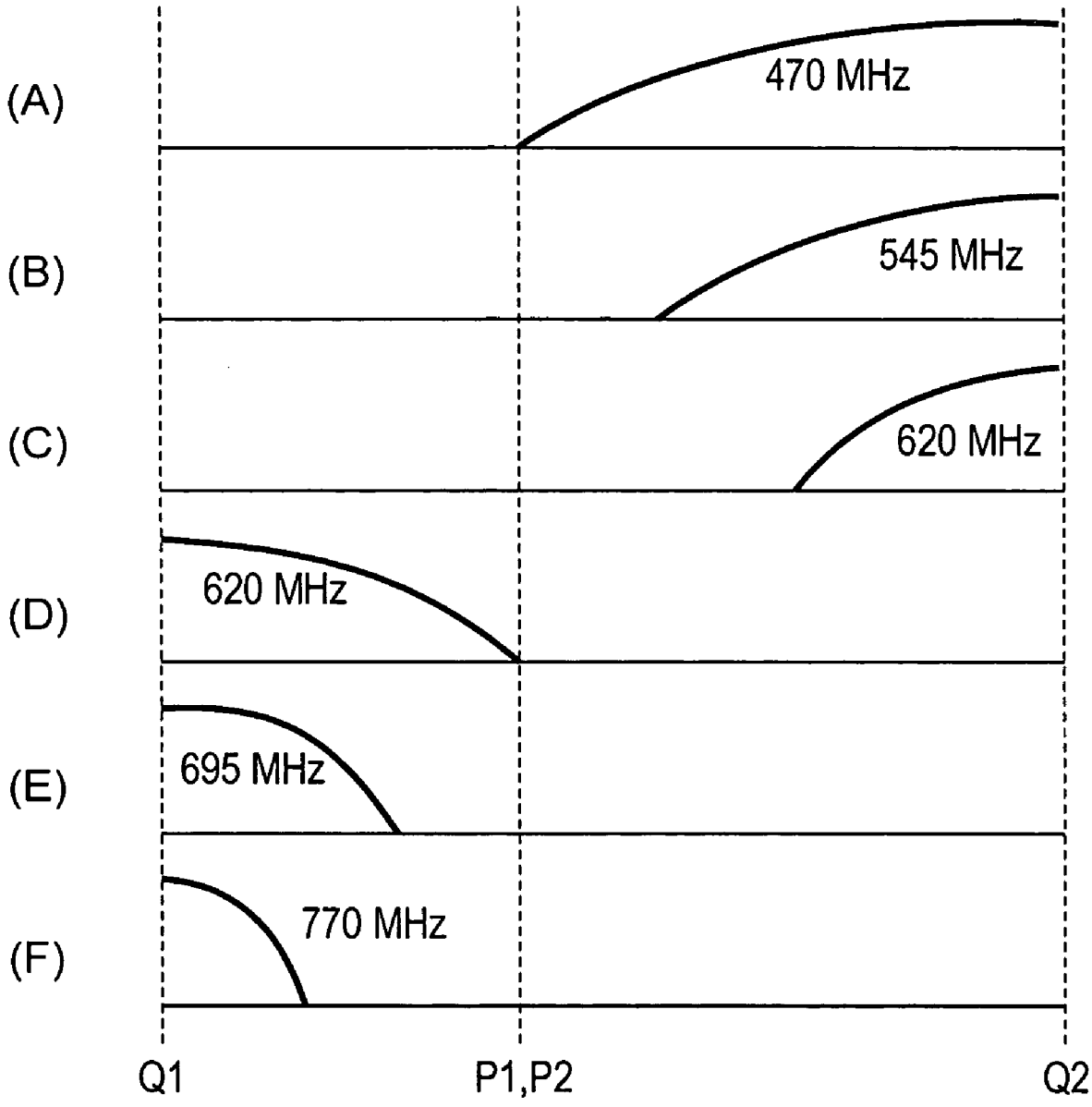
FIG. 3 is an explanatory diagram showing voltage distribution of radiation conductors in the antenna device at each resonant frequency.
Figure 4:
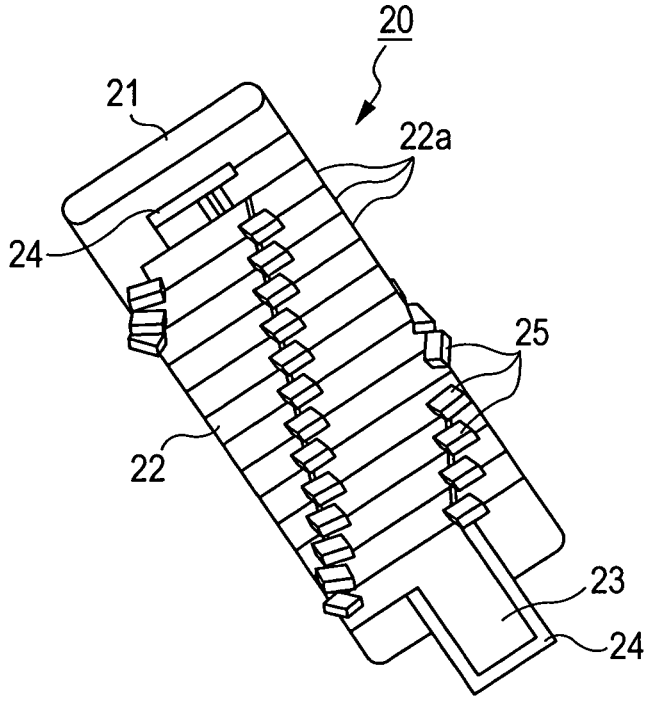
FIG. 4 PRIOR ART
FIG. 4 is a perspective view of an antenna device according to a known example.
Figure 5:
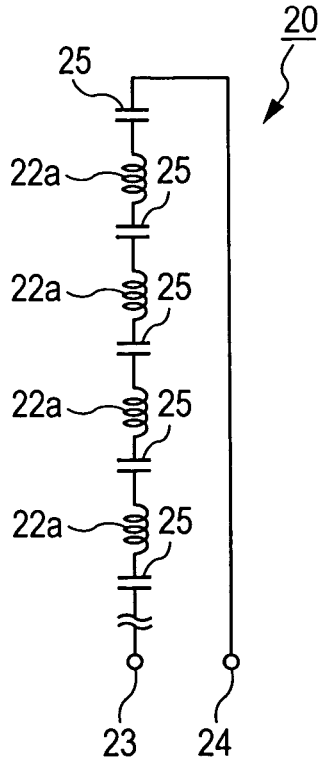
FIG. 5 PRIOR ART
FIG. 5 is an equivalent circuit diagram of the antenna device.

Embodiments of the present invention will now be described with reference to the drawings. FIG. 1 is a perspective view of an antenna device 1 according to an embodiment of the present invention. FIG. 2 is an equivalent circuit diagram of the antenna device 1. FIG. 3 is an explanatory diagram showing voltage distribution of radiation conductors of the antenna device at each resonant frequency.

The antenna device 1 shown in FIG. 1 is incorporated in a portable apparatus (for example, a cellular phone) in order to receive a UHF band for television broadcasting. The antenna device 1 is mounted on a motherboard of the portable apparatus and used. The antenna device 1 mainly includes a column-shaped substrate 2 formed of a dielectric body, a first radiation conductor 3, a second radiation conductor 4, and a third radiation conductor 5 that are wound in spirals around outer circumferential surfaces of the substrate 2, a plurality of variable capacitance elements 6 spread over lines of the first and second radiation conductors 3 and 4, and a high-frequency switch 7 interposed between feed ends P1 and P2 for a radio-frequency signal of the first and second radiation conductors 3 and 4. The high-frequency switch 7 is connected to a tuner 15 on the motherboard side. In FIG. 1, reference numerals 8 to 10 denote capacitors for removing direct-current (DC) components, reference numeral 11 denotes a feed conductor, and reference numeral 12 denotes a ground conductor. The substrate 2 may be formed of a magnetic body. The substrate 2 may have a plate shape.

The first radiation conductor 3 and the second radiation conductor 4 are wound in spirals of the same length in directions opposite to each other from a position where the high-frequency switch 7 is disposed. The same number of variable capacitance elements 6 is spread over the first and second radiation conductors 3 and 4. The first radiation conductor 3 includes a plurality of split conductor portions 3*a* to 3*d* connected in series with each other with the variable capacitance elements 6 therebetween. One end of the first radiation conductor 3 serves as the feed end P1, and the other end of the first radiation conductor 3 serves as an open end Q1. That is, the variable capacitance element 6 is connected in series between the split conductor portion 3*a* including the feed end P1 and the split conductor portion 3*b* that is adjacent to the split conductor portion 3*a*, and the variable capacitance element 6 is connected in series between the split conductor portion 3*d* including the open end Q1 and the split conductor portion 3*c* that is adjacent to the split conductor portion 3*d*. In addition, the variable capacitance element 6 is connected in series between the split conductor portions 3*b* and 3*c*. By supplying a predetermined radio-frequency signal to the feed end P1 via the high-frequency switch 7, the first radiation conductor 3 is capable of resonating in a first frequency band (620 MHz to 770 MHz), which corresponds to a higher frequency side of the UHF band for television broadcasting.

In addition, the second radiation conductor 4 includes a plurality of split conductor portions 4*a* to 4*d* connected in series with each other with the variable capacitance elements 6 therebetween. One end of the second radiation conductor 4 serves as the feed end P2. The split conductor portion 4*d*, which is at the other end of the second radiation conductor 4, is continually connected in series with the third radiation conductor 5, and one end of the third radiation conductor 5 serves as an open end Q2. That is, the variable capacitance element 6 is connected in series between the split conductor portion 4*a* including the feed end P2 and the split conductor portion 4*b* that is adjacent to the split conductor portion 4*a*. Similarly, the variable capacitance element 6 is connected in series between the split conductor portions 4*b* and 4*c*, and the variable capacitance element 6 is connected in series between the split conductor portions 4*c* and 4*d*. Since the third radiation conductor 5 extends from the split conductor portion 4*d* of the second radiation conductor 4 seamlessly, the second and third radiation conductors 4 and 5 can be regarded as a combined radiation conductor having one end serving as the feed end P2 and the other end serving as the open end Q2. The total length of the combined radiation conductor is sufficiently longer than that of the first radiation conductor 3. Thus, by supplying a predetermined radio-frequency signal to the feed end P2 via the high-frequency switch 7, the second and third radiation conductors 4 and 5 are capable of resonating in a second frequency band (470 MHz to 620 MHz), which corresponds to a lower frequency side of the UHF band for television broadcasting.

Each of the variable capacitance elements 6 is a varactor diode. When a DC tuning voltage Vt is supplied as a bias control signal from the tuner 15 to the split conductor portions 3*a* and 3*c* and the split conductor portions 4*a* and 4*c*, the tuning voltage Vt is applied across each of the variable capacitance elements 6. Thus, the capacitance of each of the variable capacitance elements 6 can be changed in accordance with the size of the tuning voltage Vt. In accordance with this, the resonant frequency of the first radiation conductor 3 and the resonant frequency of the second and third radiation conductors 4 and 5 can be changed. The split conductor portions 3*b* and 3*d* and the split conductor portions 4*b* and 4*d* are DC-grounded via resistors on the motherboard side.

As shown in the equivalent circuit diagram of FIG. 2, a terminal 7*a* of the high-frequency switch 7 is connected to the feed end P1 of the first radiation conductor 3 with the capacitor 8 for removing a DC component therebetween. In addition, a terminal 7*b* of the high-frequency switch 7 is connected to the feed end P2 of the second radiation conductor 4 with the capacitor 9 for removing a DC component therebetween. Since a terminal 7*c* of the high-frequency switch 7 is connected to a power supply circuit of the tuner 15, a power supply voltage VDD is supplied to the terminal 7*c*. In addition, since a terminal 7*d* of the high-frequency switch 7 is connected to a high-frequency circuit of the tuner 15 with the capacitor 10 for removing a DC component therebetween, a radio-frequency signal RF, such as a feed signal or a reception signal, is exchanged between the terminal 7*d* and the tuner 15. In addition, two types of switch control signal (control voltage (VCTL)) are supplied from the tuner 15 to a terminal 7*e* of the high-frequency switch 7. Since the terminal 7*e* is connected to the terminal 7*a* or the terminal 7*b* in accordance with a switch control signal, the first radiation conductor 3 and the second radiation conductor 4 are selectively connected to the high-frequency circuit of the tuner 15. In FIG. 2, reference numeral 13 denotes a capacitor for impedance matching for the first radiation conductor 3, and reference numeral 14 denotes a capacitor for impedance matching for the second and third radiation conductors 4 and 5.

In the antenna device 1 described above, the electrical length of the first radiation conductor 3 is set so as to achieve resonance in the first frequency band (620 MHz to 770 MHz), which is a higher frequency side, within a range in which the capacitances of the variable capacitance elements 6 change, and the electrical length of the second and third radiation conductors 4 and 5 is set so as to achieve resonance in the second frequency band (470 MHz to 620 MHz), which is a lower frequency side, within a range in which the capacitances of the variable capacitance elements 6 change. In addition, since the first radiation conductor 3 and the second and third radiation conductors 4 and 5 are selectively connected to the high-frequency circuit of the tuner 15 via the high-frequency switch 7, the antenna device 1 is capable of selecting a high-band mode in which the first radiation conductor 3 resonates in the first frequency band or a low-band mode in which the second and third radiation conductors 4 and 5 resonate in the second frequency band in a desired manner. That is, when the high band or the low band is selected, the antenna device 1 is capable of changing the resonant frequency of the first radiation conductor 3 or the resonant frequency of the second and third radiation conductors 4 and 5 in a desired manner within a range in which the capacitances of the variable capacitance elements 6 change. Thus, the antenna device 1 is capable of receiving a UHF band for television broadcasting over a range from a lower frequency side to a higher frequency side with an excellent sensitivity.

For the first radiation conductor 3 and the second and third radiation conductors 4 and 5 in the antenna device 1, the correlation between voltage distribution and a resonant frequency will be explained with reference to FIG. 3. The maximum voltage is always achieved at the open end Q1 or Q2. However, the minimum voltage point changes depending on the resonant frequency. That is, parts (A) to (C) of FIG. 3 show voltage distributions when the second and third radiation conductors 4 and 5 resonate at 470 MHz, 545 MHz, and 620 MHz, respectively, in the low band. When the second and third radiation conductors 4 and 5 resonate at 470 MHz, the minimum voltage point is located at the position of the feed end P2. When the second and third radiation conductors 4 and 5 resonate at 545 MHz, the minimum voltage point moves closer to the open end Q2. When the second and third radiation conductors 4 and 5 resonate at 620 MHz, the minimum voltage point moves much closer to the open end Q2. Similarly, parts (D) to (F) of FIG. 3 show voltage distributions when the first radiation conductor 3 resonates at 620 MHz, 695 MHz, and 770 MHz, respectively, in the high band. When the first radiation conductor 3 resonates at 620 MHz, the minimum voltage point is located at the position of the feed end P1. When the first radiation conductor 3 resonates at 695 MHz, the minimum voltage point moves closer to the open end Q1. When the first radiation conductor 3 resonates at 770 MHz, the minimum voltage point moves much closer to the open end Q1.

Although the space factor of the motherboard on which the antenna device 1 is mounted is improved by mounting the high-frequency switch 7 on the substrate 2 in the foregoing embodiment, the size of the antenna device 1 may be reduced by mounting the high-frequency switch 7 on the motherboard.

What is claimed is:

1. An antenna device comprising:

a substrate formed of a dielectric body or a magnetic body;

a first radiation conductor that is wound in a spiral around a portion of the substrate, one end of the first radiation conductor serving as a feed end for a radio-frequency signal;

a second radiation conductor that is wound around another portion of the substrate in a spiral whose length is equal to the spiral of the first radiation conductor, one end of the second radiation conductor serving as a feed end for the radio-frequency signal;

a third radiation conductor that is wound in a spiral around another portion of the substrate and that is connected in series with the second radiation conductor;

a plurality of variable capacitance elements spread over the first and second radiation conductors by being connected in series with split conductor portions acquired by splitting each of the first and second radiation conductors into a plurality of sections; and a high-frequency switch that is interposed between the feed ends of the first and second radiation conductors and that is connected to an external high-frequency circuit, wherein the first radiation conductor and the second and third radiation conductors are selectively connected to the high-frequency circuit by supplying a switch control signal to the high-frequency switch so that the first radiation conductor and the second and third radiation conductors resonate in frequency bands different from each other, and a resonant frequency changes within a selected frequency band by supplying a bias control signal to each of the variable capacitance elements to change a capacitance.

2. The antenna device according to claim 1, wherein the high-frequency switch is mounted on the substrate.

3. The antenna device according to claim 1, wherein each of the variable capacitance elements is a varactor diode, and a direct-current tuning voltage is applied as the bias control signal to the varactor diode.

4. The antenna device according to claim 1, wherein the frequency band in which the first radiation conductor resonates is a higher frequency side of an ultrahigh frequency band for television broadcasting, and the frequency band in which the second and third radiation conductors resonate is a lower frequency side of the ultrahigh frequency for television broadcasting.

* * * * *